US005277062A

United States Patent [19]

Blauch et al.

[11] Patent Number: 5,277,062

[45] Date of Patent: Jan. 11, 1994

[54] MEASURING IN SITU STRESS, INDUCED FRACTURE ORIENTATION, FRACTURE DISTRIBUTION AND SPACIAL ORIENTATION OF PLANAR ROCK FABRIC FEATURES USING COMPUTER TOMOGRAPHY IMAGERY OF ORIENTED CORE

[75] Inventors: Matthew E. Blauch; James J. Venditto, both of Duncan, Okla.

[73] Assignee: Halliburton Company, Dallas, Tex.

[21] Appl. No.: 897,256

[22] Filed: Jun. 11, 1992

[51] Int. Cl.[5] ..... E21B 49/02

[52] U.S. Cl. ..... 73/153; 166/250; 250/255

[58] Field of Search ..... 73/151, 153; 324/303; 250/255; 166/250; 328/4-20; 175/44

[56] References Cited

U.S. PATENT DOCUMENTS

| | | | |
|---|---|---|---|
| 4,542,648 | 9/1985 | Vinegar et al. | 73/153 |
| 4,710,946 | 12/1987 | Hinch et al. | 378/62 |
| 4,722,095 | 1/1988 | Muegge et al. | 378/4 |
| 4,781,062 | 11/1988 | Taylor | 73/152 |
| 4,799,382 | 1/1989 | Sprunt et al. | 73/153 |
| 4,856,341 | 8/1989 | Vinegar et al. | 73/798 |
| 5,036,193 | 7/1991 | Davis, Jr. et al. | 250/255 |

OTHER PUBLICATIONS

Gilliland, R. E., "Use of CT Scanning in the Investigation of Damages to Unconsolidated Cores", SPE Paper 19408, SPE Formation Damage Control Symposium, Feb. 22-23, 1990.

Suzuki, F., "X-ray Computed Tomography for Carbonate Acidizing Studies", Paper No. CIM/SPE 90-45, CIM/SPE Meeting in Calgary, Jun. 10-13, 1990.

Vinegar, H. J., "X-ray CT and NMR Imaging of Rocks", J. of Petroleum Technology, Mar. 1986, pp. 257-259.

Bergosh, J. L. et al., "New Core Analysis Techniques for Naturally Fractured Reservoirs", SPE Paper 13653 presented at the 1985 SPE California Regional Meeting, Bakersfield, Mar. 27-29, 1985.

Honarpour, M. M. et al., "Reservoir Rock Descriptions Using Computed Tomography (CT)", SPE Paper 14272, 60th Annual Technical Conference, Sep. 22-25, 1985.

Hunt, P. K. et al., "Computed Tomography as a Core Analysis Tool: Applications and Artifact Reduction Techniques", SPE Paper 16952, 62nd Annual Technical Conference; Sep. 27-30, 1987.

*Primary Examiner*—Robert J. Warden
*Assistant Examiner*—Krisanne M. Thornton
*Attorney, Agent, or Firm*—Arnold, White & Durkee

[57] ABSTRACT

A method for measuring the azimuthal strike orientation of induced fractures in subterranean formations from which the maximum and minimum in situ stress direction can be inferred. The method utilizes an oriented core of a formation and computed tomography imagery for measuring the azimuthal strike orientation of induced fractures.

15 Claims, 4 Drawing Sheets

Fig. 1a
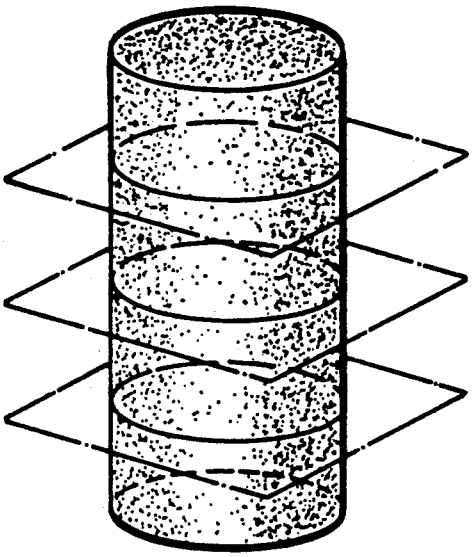
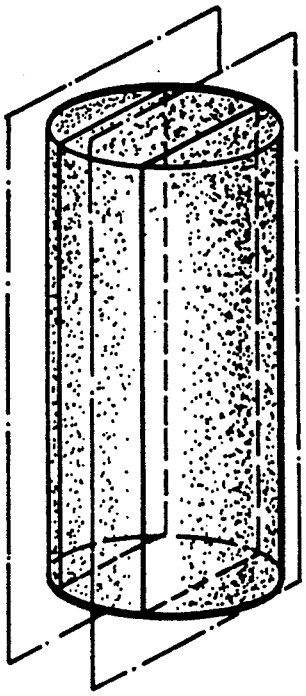
Fig. 1b
Fig. 2
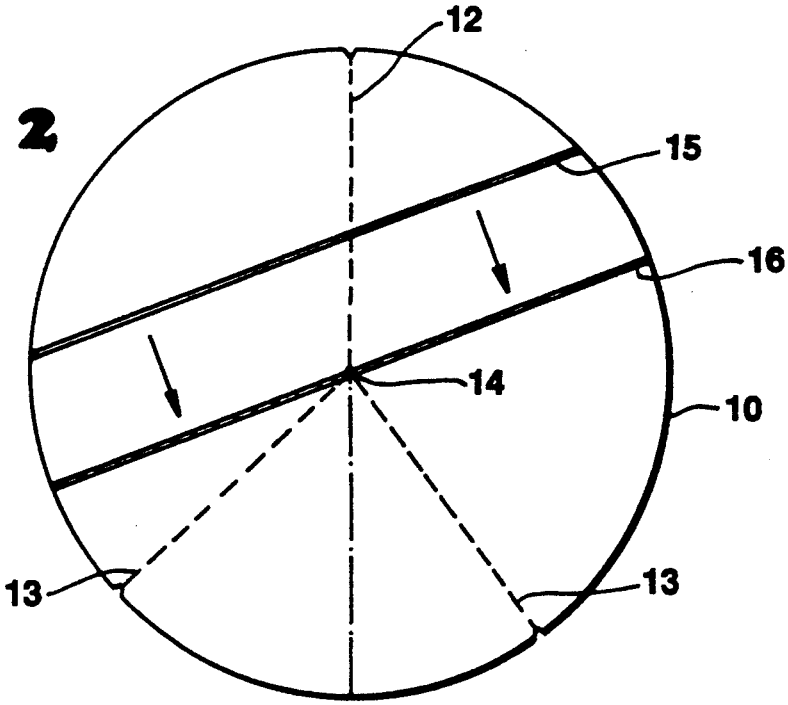

MEASURING IN SITU STRESS, INDUCED FRACTURE ORIENTATION, FRACTURE DISTRIBUTION AND SPACIAL ORIENTATION OF PLANAR ROCK FABRIC FEATURES USING COMPUTER TOMOGRAPHY IMAGERY OF ORIENTED CORE

BACKGROUND OF THE INVENTION

1. Field of the Invention

The present invention relates to a method for measuring the azimuthal strike orientation of induced fractures in subterranean formations from which the maximum and minimum in situ stress direction can be inferred. More particularly, the present invention relates to a method for direct measurement of the azimuthal strike orientation of induced fractures by using an oriented core and computed tomography imagery. The method of the present invention can also be extended to the direct measurement of the spatial orientation of other planar rock fabrics causing mechanical rock anisotropy which can be compared to the induced fracture orientation.

2. Background

The ability to predict and/or measure hydraulic fracture orientation and in situ stress direction in an oil and gas reservoir is important for optimum field development in hydraulically stimulated reservoirs, for well placement, stimulation design, injection of fluids and is important for decisions for optimum placement of horizontal oil and gas wells. Knowing the fracture direction allows the field well spacing to be determined, and the shape of the drainage area to be established. Several methods exist in the oil and gas industry for measuring, or at least inferring, hydraulic fracture orientation in subterranean formations and for inferring the direction of the maximum horizontal in situ stress.

One of the previously known methods for determining fracture orientation involved performing an open hole microfrac test in a well, and thereafter, taking an oriented core sample from the bottom of the well bore and visually observing the direction of the fractures induced during the microfrac test.

Another prior art technique for inferring fracture orientation involves the use of anelastic strain ("ASR") techniques. An ASR test consists of immediately sectioning and placing in a test apparatus a portion of a freshly cut and recovered oriented core section for recording the expansion/contraction of the rock due to the release of the stress pattern it has been under in place. The core is placed in a test fixture and the minute oriented displacements recorded for 24 to 48 hours, until movement ceases. Since the stress within a formation is proportional to the strain relaxation in the core sample, the direction of the minimum and maximum horizontal stress within the formation may be inferred from the relaxation data.

A recently developed non-prior art technique for determining fracture orientation is through use of an acoustic scanning tool (CAST) to determine fracture orientation after fractures have been induced in the formation by an open hold microfrac test. The CAST is an oriented sonic tool that may be used to observe the interior of a well bore. Observation of the induced fractures with the CAST allows an operator to directly observe the orientation of both natural and induced fractures.

Yet another new non-prior art method for measuring the direction of hydraulic fracture orientation has been developed. This technique involves the use of downhole extensiometers to measure borehole diameter changes before and after fractures have been initiated in the formation. This method and technique is the subject of a separately filed application which is assigned to the assignee of the present invention (application Ser. No. 07/902,108, filed Jun. 22, 1992). A downhole extensiometer such as Halliburton Services, Inc.'s THE TM tool is an instrument which measures borehole deformation during a fracture. THE TM tool is a high precision oriented, multi-armed caliper with a high accuracy memory pressure gauge. This tool will be in the hole during a microfracture treatment to measure the actual fracture width created. THE TM tool uses straddle packers to isolate and test individual zones in an open hole. Deformation of the borehole will give an indication of the azimuthal strike orientation of the induced fracture.

The data from the existing prior art methods is often not available, lacks verification, is only obtained as a single measurement lacking statistical certainty or is inferred from indirect techniques which can be difficult to interpret. The method of the present invention is one which may provide verification of these other methods in a particular field and is a direct measurement which can be coupled with several of the existing methods. The method of the present invention can also be extended to the direct measurement of the planar rock fabrics causing mechanical rock anisotropy which can be compared to the hydraulic fracture orientation.

The method of the present invention provides a direct measurement of azimuthal strike orientation of induced fractures from which maximum and minimum stress directions can be inferred. Maximum in situ stress is shown to be aligned parallel to the strike orientation of induced core fractures. A hydraulically induced fracture will propagate perpendicular to the least principal stress and in the direction of the greatest principal stress. The proposed method requires the use of an oriented whole core and computed tomography (CT) imagery.

Coring and core orientation techniques are well-known in the industry. One such technique for core orientation includes the use of a downhole camera and compass. Orientation data is obtained by taking photographs of the downhole compass at desired intervals over the cored section. By way of example, downhole compass photographs are obtained every three feet through the section being cored. Rotation of the core bit is stopped at the desired depth to obtain a readable photograph of the downhole compass.

Orientation grooves, the principal and secondary scribe lines, are marked on the core as the core is being cut. Knives inside the core barrel cut the scribe lines as the core enters the core barrel. The orientation of the principal scribe with respect to the compass is recorded prior to running the core barrel into the borehole. Thus, one can determine the orientation of the principal scribe line from the compass readings at each recorded interval. The secondary scribe lines are used as a reference for identifying the principal scribe. A survey record will exist at the conclusion of the cored section which accurately reflects the orientation of the core's principal scribe line throughout the interval. Orientation of the core is considered a critical part of obtaining accurate orientation measurements of planar core features such as fractures. State of the art continuous orientation technology which is now available to the industry is an alternative to "camera" technique of core orientation described above.

Computed tomography (CT), commonly known in the medical field as CAT scanning ("computerized axial tomography" or "computer assisted tomography"), is a nondestructive technology that provides an image of the internal structure and composition of an object. What makes the technology unique is the ability to obtain imaging which represents cross sectional "axial" or "longitudinal" slices through the object. This is accomplished through the reconstruction of a matrix of x-ray attenuation coefficients by a dedicated computer system which controls the scanner. Essentially, the CT scanner is a device which detects density differences in a volume of material of varying thicknesses. The resulting images and quantitative data which are produced reflect volume by volume (voxel) variations displayed as gray levels of contrasting CT numbers.

Although the principles of CT were discovered in the first half of this century, the technology has only recently been made available for practical applications in the non-medical areas. Computed tomography was first introduced as a diagnostic x-ray technology for medical applications in 1971, and has been applied in the last decade to materials analysis, known as non-destructive evaluation. The breakthroughs in tomographic imaging originated with the invention of the x-ray computed tomographic scanner in the early 1970's. The technology has recently been adapted for use in the petroleum industry.

A basic CT system consists of an x-ray tube; single or multiple detectors; dedicated system computer system which controls scanner functions and image reconstructions and post processing hardware and software. Additional ancillary equipment used in core analysis include a precision repositioning table; hard copy image output and recording devices; and x-ray "transparent" core holder or encasement material.

A core is laid horizontally on the precision repositioning table. The table allows the core to be incrementally advanced a desired distance thereby ensuring consistent and thorough examination of each core interval. The x-ray beam is collimated through a narrow aperture (2 mm to 10 mm), passes through the material as the beam/object is rotated and the attenuated x-rays are picked up by the detectors for reconstruction. Typical single energy scan parameters are 75 mA current at an x-ray tube potential of 120 kV. After image reconstruction, a cross-sectional image is displayed and the data stored on tape or directly to a computer disk. One example of obtaining image output is through hard copies in the form of 35 mm slides directly from image disks which may then be reproduced into 8.5×11 inch photographic sheets directly from the slides.

A cross sectional slide of a volume of material can be divided into an n x n matrix of voxels (volume elements). The attenuated flux of $N_o$ x-ray photons passing through any single voxel having a linear attenuation coefficient $\mu$ reduces the number of transmitted photons to N as expressed by Beer's law:

$$N/N_o = e^{-\mu/x}$$

where:

N=number of photons transmitted $N_o$=original number of emitted photons x=dimension of the voxel in the direction of transmitted beam $\mu$=linear attenuation coefficient (cm).

Material parameters which determine the linear attenuation coefficient of a voxel relate to mass attenuation coefficient as follows:

$$\mu = (\mu/\rho)\rho$$

where: $(\mu/\rho)$ is the mass attenuation coefficient (MAC) and $\rho$ is the object density.

Mass attenuation coefficients are dependent on the mean atomic number of the material in a voxel and the photon energy of the beam [approx. $(KeV)^{-3}$]. For a heterogeneous voxel, i.e., compounds and mixtures, the atomic number depends on the weighted average of the volume fraction of each element (partial volume effect). Therefore, the composition and density of the material in a voxel will determine its linear attenuation coefficient.

Computed tomography calculates the x-ray absorption coefficient for each pixel as a CT number (CTN), whereby:

$$CTN = 1000\frac{\mu - \mu_w}{\mu_w}$$

where: $\mu_w$ is the linear attenuation coefficient of water.

Conventionally, CT numbers are expressed as normalized MAC's to that of water. The units are known as Hounsfield units (HU) and are defined as O HU for water and (−1000) HU for air. Rearrangement of the previous equation can therefore be expressed as:

$$\text{CTN (CT number)} = 1000\times((\mu/\rho)\rho/(\mu/\rho)_w\rho_w - 1)$$

where:

$(\mu/\rho)_w$=mass attenuation coefficient of water $\rho_w$=density of water

Core lithology can be determined by single scan CT with the knowledge of the density (or grain density) and attenuation coefficient of the material. For sandstones, limestones, and dolomites, the grain densities are usually close to the literature values (2.65, 2.71, and 2.85 g/cm$^3$, respectively). Typical densities can also be used for rock of mineral types such as gypsum, anhydrite, siderite, and pyrite.

The mass attenuation coefficients of various elements and compounds can be found in the nuclear data literature. The mass attenuation coefficient for composite materials can be determined from the elemental attenuation coefficients by using a mass weighted averaging of each element in the compound as shown:

$$MAC = \frac{\Sigma M_i(MAC)}{\Sigma M_i}$$

where $M_i$ is the molecular weight for element i.

Note that calcite MAC values are higher than those for dolomite, even though dolomite has a higher grain density than calcite. This is because of the atomic number dependence. Water and decane have very similar MAC values. The higher atomic number (and MAC value) materials are more nonlinear with x-ray energy than the lower atomic number materials.

In general, sandstones or silicon-based materials have CT numbers in the 1000–2000 range, depending on the core porosity. Limestones and dolomites are typically in the 2000–3000 CTN range.

Small impurities of different elements in a core can change the core's CT numbers. For instance, the presence of calcium in a sandstone core maxtrix will increase the core's CT number above what would be predicted from the porosity vs. CTN curve. An estimate of the weight fraction of each element in the core can give a better estimate of the core porosity.

The occurrence of abrupt changes in CT number may indicate lithology discontinuities in the core. For instance, the presence of small high density/high CT number nodules (CTN<2000) usually indicates the presence of iron in the core (pyrite, siderite, glauconite). For limestones the presence of higher density/CTN nodules (CTN>3400) in the limestone matrix may indicate anhydrite in the core. A high CTN/high density region near the outer part of the core may indicate barite mud invasion. This procedure is an excellent way to verify mud invasion and estimate its extent.

Quantitative CT scanning of cores requires modifications to the techniques employed for medical applications. The CT scanner must be tuned for reservoir rocks rather than water in order to obtain quantitatively correct measurements of CT response of the cores. Since repeat scanning of specific locations in the sample is often necessary, more accurate sample positioning is required than is needed in medical diagnostics.

SUMMARY OF THE INVENTION

The present invention relates to a method for measuring the azimuthal strike orientation of induced fractures in subterranean formations using an oriented core and computed tomography imagery. The present invention describes a method for directly measuring the azimuthal strike orientation of induced fractures from a computed tomographic image of an oriented core. The maximum and minimum in situ stress direction can be inferred from the orientation of such induced fractures. The method of the present invention can also be extended to the direct measurement of the spatial orientation of other planar rock fabrics causing mechanical rock anisotropy.

Measurements taken according to the present invention provide information pertaining to stress orientation and the relationships of the current stress (determined from induced fractures) to the paleo stress inferred from natural fractures and planar rock fabrics such as preferred alignment of minerals. Induced fracture orientation and in situ stress analysis is performed on an oriented core following a downhole microfracture treatment.

The objects and advantages of the present invention will become readily apparent from the following description of the preferred embodiment taken in conjunction with the accompanying drawings.

BRIEF DESCRIPTION OF THE DRAWINGS

FIG. 1*a* is a cross-sectional view of a horizontal CT scan image through a cylindrical core.

FIG. 1*b* is a cross sectional view of a longitudinal CT scan image through a cylindrical core.

FIG. 2 is a schematic for obtaining fracture orientation from CT slice data in reference to orientation scribes.

DESCRIPTION OF THE PREFERRED EMBODIMENT

Figure 3:
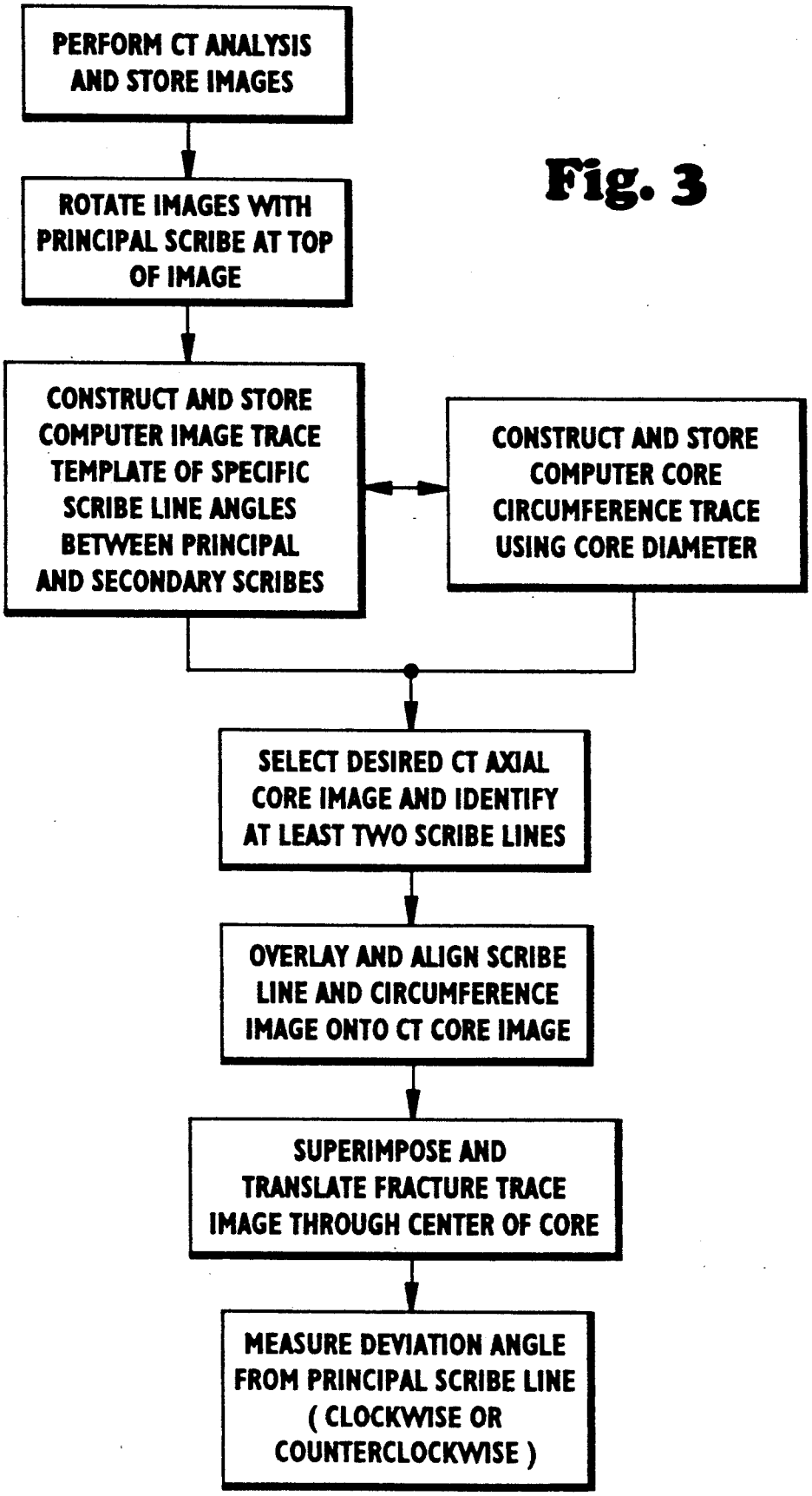
FIG. 3 is a flow chart of a computer software program for measuring the orientation of a fracture in an oriented core.

The preferred embodiment of the present invention is a method for direct measurement of the azimuthal strike orientation of induced fractures in a formation or reservoir. Prior to coring the targeted reservoir, a fracture is induced by a microfracture treatment (also referred to as a "microfrac"). Drilling is stopped after penetrating the top of the formation. An open hole expandable packer is set in the borehole above the formation to be tested. Typically, the packer would be set to expose 10–15 feet of hole. A microfrac treatment uses a very slow injection rate and 1–2 barrels of drilling mud or other suitable fluid to create a small fracture in the formation.

After the microfrac treatment is terminated, the open hole packer is removed from the borehole. The microfrac is followed by the drilling and recovery of an oriented core specimen from the formation. This core will contain part of the actual fracture or fractures created during the microfracture treatment. The orientation of the induced fracture or fractures will indicate the direction of the least principal stress as the fracture will propagate in a direction perpendicular to the least principal stress.

The core would preferably be contained in a core tube which is removed at the surface from the core barrel used to cut the core. The core tube is typically made of fiberglass, aluminum or other suitable materials. The depth of the cored interval is noted on the core tube as it is removed from the core barrel. The core tube with the core inside is sent to a lab having computed tomography facilities for analysis.

The core tube, with the core inside, is placed horizontally preferably on a precision repositioning table. A computerized tomographic scanner (CT scanner) will take two dimensional slice images of the core. The two dimensional slices can then be reconstructed into 3-D images or 2-D images in various planes. The scanner consists of a rotating x-ray source and detector which circles the horizontal core on the repositioning table. The table allows the core to be incrementally advanced a desired distance thereby ensuring consistent inspection of each core interval. X-rays are taken of the core at desired intervals. The detector converts the x-rays into digital data that is routed to a computer. The computer converts the digital x-ray data into an image which can be displayed on a CRT screen. These images are obtained preferably in an appropriate pixel format for full resolution. A hard copy of the image can be obtained if desired. The image represents the internal structure and composition of the core.

CT images can be obtained which represent cross-sectional "axial" or "longitudinal" slices through the core. Axial and longitudinal scan slices are illustrated in FIGS. 1A and 1B, respectively. For axial images, CT scan images are taken perpendicular to the longitudinal axis of the core. A longitudinal image is created by reconstructing a series of axial images. Images can be obtained along the entire length of the core at any desired increment. Slice thickness typically range from 0.5 mm to 2.0 mm. The images thus obtained can discern many internal features within a formation core including cracks, hydraulic and mechanically induced fractures, partially mineralized natural fractures and other physical rock fabrics. These features are represented by CT numbers which differ from the CT number of the surrounding rock matrix. A CT number is a function of the density and the atomic number of the material. For a given mineralogy, a higher CT number represents a higher density and therefore a lower porosity. Due to the high CT number contrast between an opened induced fracture and the surrounding rock matrix, the induced fracture can be observed directly in the images even though a narrow hairline fracture may not be readily observed on the outside perimeter of the core.

FIG. 2 represents a schematic of the procedure for obtaining fracture orientation from a CT image. Using an axial slice image from the recovered core, the CT computer generates a circumferential trace 10 about the circumference of the core image. The principle and secondary scribe marks on the oriented core will appear as indentation on the circumference of the scan image. From these indentations, the computer generates the principal 12 and secondary 13 scribe lines on the image. The intersection of the principle and secondary scribe lines coincide with the geometric center 14 of the image. The induced fracture 15 is then identified on the core image. Since a fracture will rarely be in the center of the core, it is necessary to translate the fracture orientation to the center of the core image.

A trace of the fracture is created by translating and projecting the fracture orientation through the geometric center 14 of the circumference of the core, as indicated by the arrows in FIG. 2. The fracture trace 16 will be parallel to the induced fracture 15 identified in the scan image. The angle between the principal scribe 12 and the fracture trace 16 is measured along the circumferential trace of the core image with a positive (clockwise) or negative (counterclockwise) angle. In other words, compass direction or azimuthal strike orientation is measured from the principal scribe to where fracture trace 16 intersects the circumferential trace of the core image. When the compass orientation for the principal scribe mark at the image core depth is determined from the core orientation data, the angle between the principal scribe line and the fracture trace is then converted to azimuthal orientation with respect to true north. This process can be performed through manual measurements or automatically through a computer software program which performs the angle measurement and calculation. A flow chart representing the steps of a computer software program for measuring the orientation of a fracture is illustrated in FIG. 3. The strike orientation of other planar rock features can be determined by the same procedure.

Two example calculations of induced fracture strike orientation are provided for clockwise and counterclockwise angle measurements from the principal scribe. The following formula is used in the calculation:

$$S_1+D=S_2$$

where:

$S_1$=Principal scribe orientation at an indicated depth in degrees east or west of north from 0 to 90.

D=Angle deviation from the principal scribe of the fracture trace projected through the core center intersected at the core perimeter. Clockwise angles from the principal scribe are designated as positive values. Counterclokwise angles from the principal scribe are designated as negative values.

$S_2$=Resultant induced fracture strike orientation with respect to true north (degrees east or west of north).

NOTE: The sign of the deviation angle (D) will be reversed when $S_2$ changes from the NE to the NW quadrant.

Example 1:

Extrapolated $S_1$ orientation from true north=N52E.

CT measured deviation angle D=+8

$S_1+D=S_2$

52+(+8)=60 degrees

Induced fracture strike orientation ($S_2$)=N60E

Example 2:

Extrapolated $S_1$ orientation from true north=N81.5E.

CT measured deviation angle D=−22

$S_1+D=S_2$ 81.5+(−22)=58.5 degrees

Induced fracture strike orientation ($S_2$)=N58.5E

Both examples were obtained from identified induced fractures obtained at two different depth markers from an oriented core retrieved from competent Devonian shale in Roane Co. West Virginia. Note consistency of induced fracture strike despite rotation of the principal scribe orientation in the recovered core.

Figure 4:
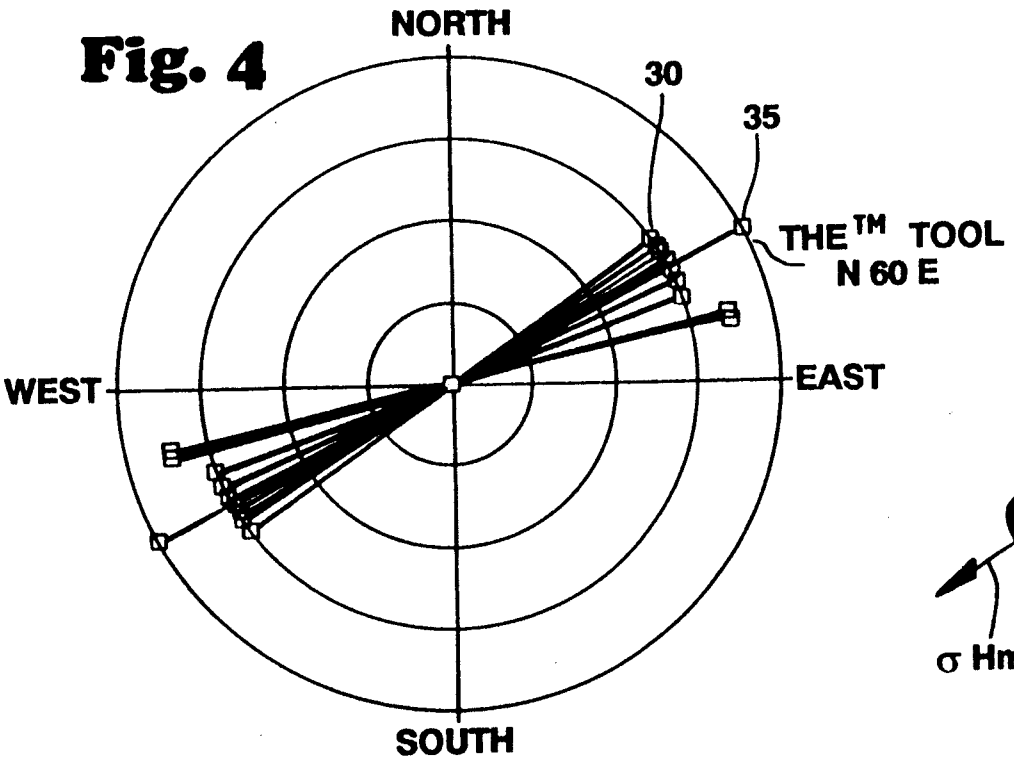
FIG. 4 is an induced fracture strike orientation plot.

FIG. 4 shows a series of induced fracture data points, identified collectively as 30, at two different core depths in two core intervals. As can be seen in FIG. 3, this data supports the single point downhole hydraulic fracture orientation obtained from THE TM tool, 35, in the same well, with the median of 11 core induced data points being within 2 degrees of the inferred hydraulic fracture orientation obtained by THE TM tool. The data points shown in FIG. 4, were obtained from the Devonian shale described above, in Roane Co., West Virginia. The orientation of the minimum in-situ stress would be inferred to be substantially perpendicular to the induced fracture orientation, which in FIG. 3 would be approximately N30W.

Figure 5:
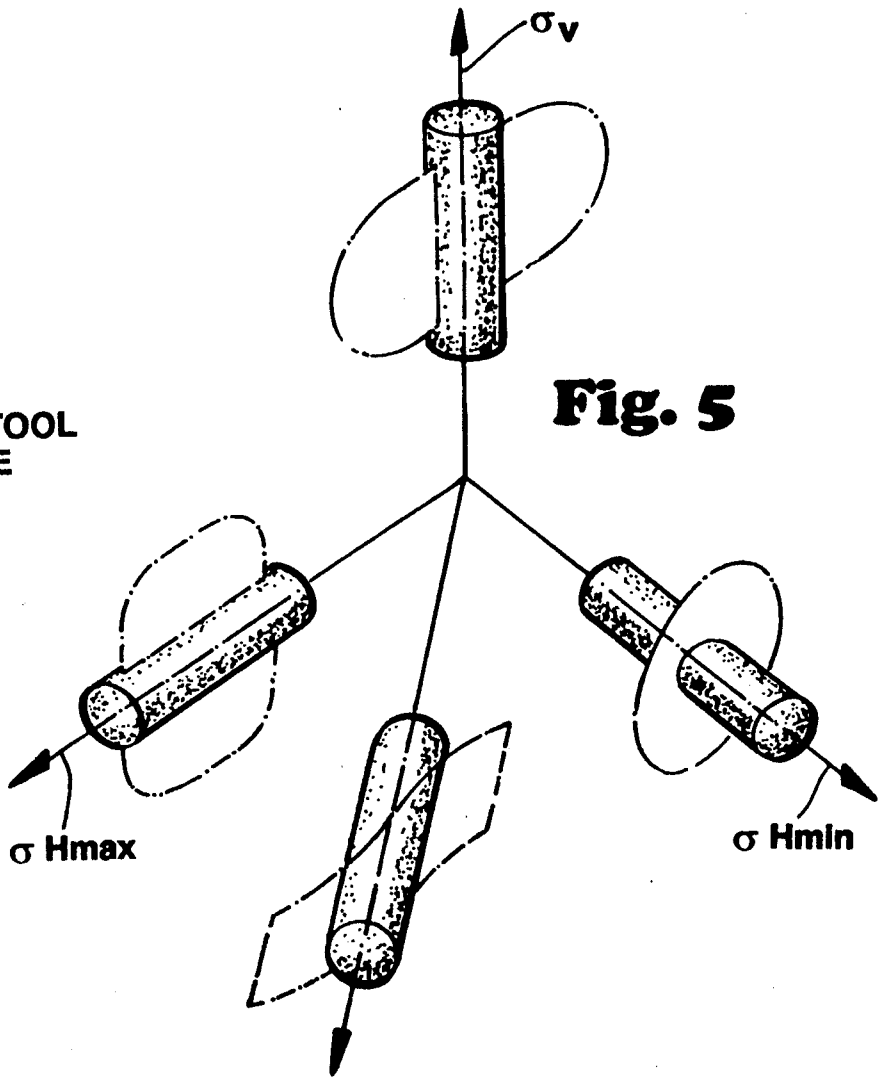
FIG. 5 illustrates the generalized fracture orientation with respect to well bore orientation and stress orientation.

FIG. 5 is a three dimensional view of the relationship between the orientation of induced fractures and minimum and maximum stress orientation, where:

$\sigma_{H\,max}$=maximum in-situ horizontal stress orientation $\sigma_{H\,min}$=minimum in-situ horizontal stress orientation $\sigma_v$=vertical stress orientation.

The orientation of the induced fracture will be perpendicular to the minimum in situ stress as shown on the $\sigma_{H\,min}$ axis and parallel to the maximum in situ stress as shown on the $\sigma_{H\,max}$ axis. The induced fracture orientation will be at an approximately 45° angle to the core when the core is oriented at 45° angle to the maximum and minimum in situ stress. The orientation of the induced fracture will change with respect to the well bore but not with respect to the minimum and maximum in situ stress orientation.

Figure 6:
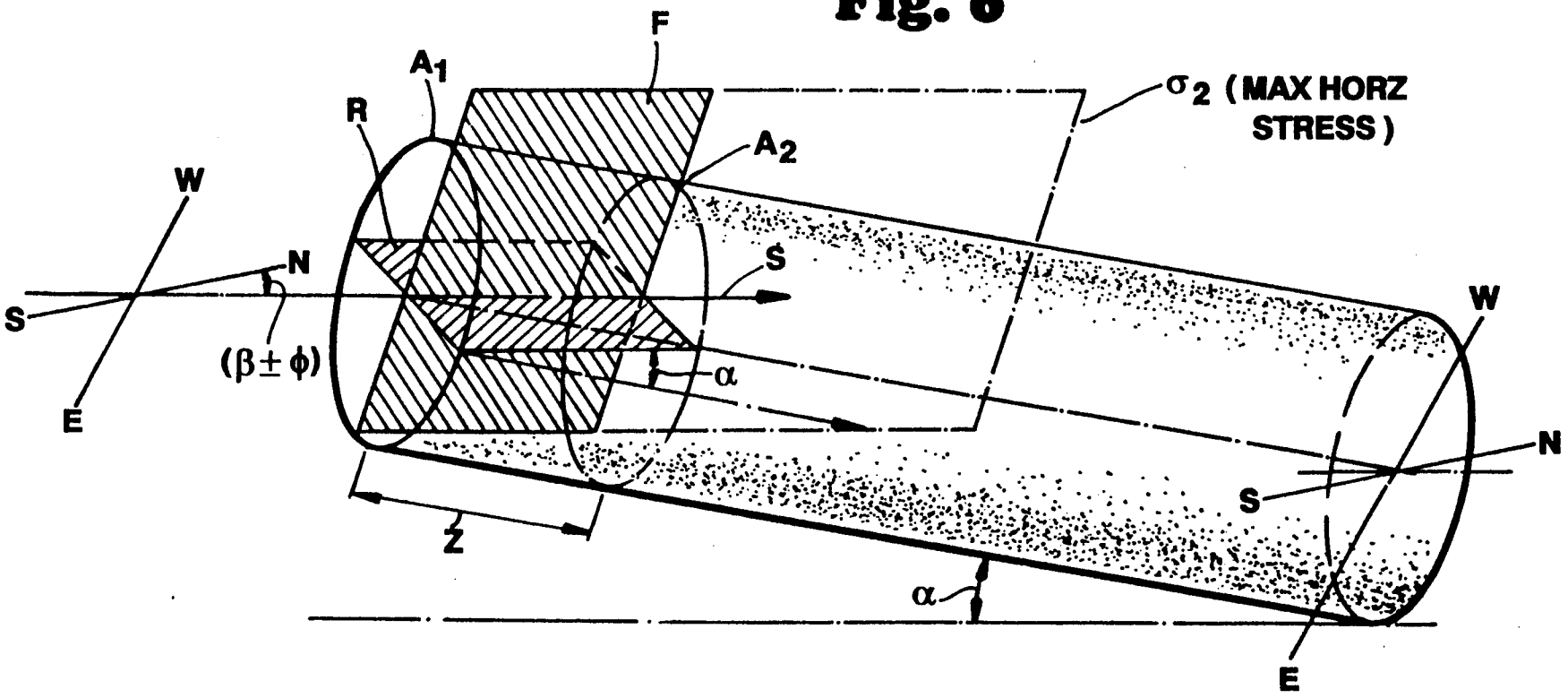
FIG. 6 is a graphical solution to the fracture orientation for deviated or horizontal wellbore/core.

In a vertical well, the images are taken in a perpendicular plane to the vertical axis of the well. As a result, the strike orientation can be determined directly in relation to the principal scribe orientation which is recalculated with respect to compass direction or azimuth. In a deviated well, the apparent strike must be corrected for the deviation. In addition, the spatial orientation can be determined by calculating dip angle and direction from sequential slice images. FIG. 6 illustrates a graphical solution for measuring the fracture orientation in a deviated or horizontal well using CT imagery where:

F=plane of induced fracture;

S=line of induced fracture strike;

$A_1$ to $A_2$=a series of sequential axial CT slice images from interval Z;

R=plane of longitudinal reconstructed CT image in horizontal plane;

$\alpha$=angle of wellbore deviation from horizontal plane;

$\phi$=angle of wellbore deviation form North;

$\beta$=angle of fracture trace deviation from $\phi$; and $\beta+\phi$=strike orientation from North.

The CT computer can be used to construct a longitudinal or horizontal image by reconstructing a series of axial slices. The fracture trace on the reconstructed longitudinal or horizontal image will represent the strike orientation. The same process as described above for a vertical well is then used to measure the azimuthal direction of the fracture trace.

The spatial orientation of other planar rock fabric features can also be measured using computed tomographic imagery of an oriented core. Examples of other planar rock fabric features which can be measured by the present invention include mineralized natural fractures, microfracture systems, cross bedding planes, deformed minerals and fossils, bedding plane surfaces, foliation and schistosity and high angle mineralized bedding planes. The azimuthal strike orientation of other planar rock fabric features is measured in the same manner as an induced fracture is measured. A trace of the rock fabric feature, such as a mineralized natural fracture, is translated to the geometric center of the core image. The angle between the rock fabric feature trace and the principal scribe is measured directly from the CT image. This angle is converted to the azimuthal strike orientation based on the orientation of the principal scribe line to true north.

The dip angle of the planar rock fabric feature of interest may also be directly measured from the CT scan images. A first CT scan image is taken perpendicular to the longitudinal axis of the core. The planar rock fabric feature is identified on the image. A second CT scan image is taken perpendicular to the longitudinal axis of the core at a known distance from the first scan image. The second CT scan image is then superimposed on top of the first CT scan image. The images may be superimposed on the computer screen or by overlying hard copies of the images. It is important to align the principle and secondary scribe lines of the two super imposed images prior to taking measurments.

The displacement between the planar rock fabric feature in the first CT image and the second CT scan image is measured by the computer, or by hand in the case of hard copy images. The displacement of the planar rock fabric feature and the distance between the points where the two scan images were taken represent two sides of a right triangle, from which the hypotenuse and ultimately, the dip angle can be calculated. Stated another way, from the horizontal displacement of the rock fabric and the vertical distance between the two images, the slope or dip angle can be calculated.

The CT scan will also identify natural mineralized fractures in a core. The angular relationship between a natural mineralized fracture and an induced fracture may be important information in the development of a reservoir. The orientation of the natural mineralized fracture will indicate the orientation of the paleo stress whereas the orientation of the induced fracture will indicate the orientation of the current stress of the reservoir. This information may determine whether a horizontal wellbore is required (where induced fracture is parallel to natural fractures) or whether conventional hydraulic fracture stimulation will suffice (where induced fracture intersects existing natural fractures).

It will be understood by those skilled in the art that certain variations and modifications may be made without departing from the spirit and scope of the invention as defined herein and in the appended claims.

What is claimed is:

1. A method of measuring the azimuthal strike orientation of an induced fracture in a subterranean formation comprising the steps of:

(a) inducing a fracture in the formation;

(b) drilling an oriented core through the formation, the oriented core containing a principal scribe line;

(c) recovering the oriented core;

(d) taking a computed tomographic scan image of the oriented core;

(e) identifying the induced fracture from the computed tomographic scan image;

(f) creating a fracture trace by translating the orientation of the induced fracture through the geometric center of the scan image of the oriented core;

(g) measuring the angle between the fracture trace and the principal scribe; and (h) converting the measured angle to an azimuthal strike orientation.

2. The method of measuring the azimuthal strike orientation of an induced fracture in a subterranean formation as recited in claim 1 wherein computed tomographic scan images are taken at a plurality of locations along the length of the oriented core.

3. The method of measuring the azimuthal strike orientation of an induced fracture in a subterranean formation as recited in claim 1 wherein the computed tomographic scan image is taken at slice thickness ranging from about 0.5 mm to about 2.0 mm.

4. The method of measuring the azimuthal strike orientation of an induced fracture in a subterranean formation as recited in claim 1 wherein the computed tomographic scan image is taken perpendicular to the longitudinal axis of the core.

5. A method of measuring the azimuthal strike orientation of an induced fracture in an oriented core comprising the steps of:

a) taking a computed tomographic axial scan image of the oriented core;

b) generating a circumferential trace about the scan image of the oriented core;

c) identifying a principal scribe line from the scan image of the oriented core;

d) identifying the induced fracture from the computed tomographic image;

e) generating a fracture trace by translating the orientation of the induced fracture through the geometric center of the scan image of the oriented core;

f) measuring the angle between the fracture trace and the principal scribe line; and g) converting the measured angle to an aximuthal strike orientation.

6. A method of measuring the azimuthal strike orientation of an induced fracture in an oriented core comprising the steps of:

a) taking a computed tomographic axial scan image of the oriented core;

b) generating a circumferential trace about the scan image of the oriented core;
c) identifying an orientation indicator from the scan image of the oriented core;
d) identifying the induced fracture from the computed tomographic image;
e) generating a fracture trace by translating the orientation of the induced fracture through the geometric center of the scan image of the oriented core;
f) measuring the angle between the fracture trace and the orientation indicator; and
g) converting the measured angle to an azimuthal strike orientation.

7. A method of measuring the azimuthal strike orientation of a planar rock fabric feature in a subterranean formation comprising the steps of:
(a) drilling an oriented core through the formation, the oriented core containing principal and secondary scribe lines;
(b) recovering the oriented core;
(c) taking a computed tomographic scan image of the oriented core;
(d) identifying the planar rock fabric feature from the computed tomographic scan image.
(e) creating a planar rock fabric trace by translating the orientation of the planar rock fabric feature through the geometric center of the scan image of the oriented core;
(f) measuring the angle between the planar rock fabric feature trace and the principal scribe; and
(g) converting the measured angle to an azimuthal strike orientation.

8. The method of measuring the azimuthal strike orientation of a planar rock fabric feature in a subterranean formation of claim 7 wherein computed tomographic scan images are taken at a plurality of locations along the length of the oriented core.

9. The method of measuring the azimuthal strike orientation of a planar rock fabric feature in a subterranean formation of claim 7 wherein the computed tomographic scan image is taken at slice thicknesses ranging from about 0.5 mm to about 2.0 mm.

10. The method of measuring the azimuthal strike orientation of a planar rock fabric feature in a subterranean formation of claim 7 wherein the computed tomographic scan image is taken perpendicular to the long axis of the core.

11. The method of measuring the azimuthal strike orientation of a planar rock fabric feature in a subterranean formation of claim 7 wherein the planar rock fabric feature is a bedding plane.

12. The method of measuring the azimuthal strike orientation of a planar rock fabric feature in a subterranean formation of claim 7 wherein the planar rock fabric feature is a mineralized bedding plane.

13. The method of measuring the azimuthal strike orientation of a planar rock fabric feature in a subterranean formation of claim 7 wherein the planar rock fabric feature is a mineralized natural fracture.

14. The method of measuring the azimuthal strike orientation of a planar rock fabric feature in a subterranean formation of claim 7 wherein the planar rock fabric feature is a natural microfracture system.

15. A method of measuring the dip angle of a planar rock fabric feature in a subterranean formation comprising the steps of:
(a) drilling an oriented core through the formation, the oriented core containing principal and secondary scribe lines;
(b) recovering the oriented core;
(c) taking a first computed tomographic scan image perpendicular to the longitudinal axis of the oriented core;
(d) identifying the planar rock fabric feature from the first computed tomographic scan image;
(e) taking a second computed tomographic scan image perpendicular to the longitudinal axis of the oriented core at a known axial distance from the first scan image;
(f) identifying the planar rock fabric feature from the second computed tomographic scan image;
(g) measuring the displacement between the planar rock fabric feature in the first scan image and the planar rock fabric feature in the second scan image; and
(h) calculating the dip angle between the planar rock fabric feature in the first scan image and the planar rock fabric feature in the second scan image.

* * * * *

UNITED STATES PATENT AND TRADEMARK OFFICE

CERTIFICATE OF CORRECTION

PATENT NO. : 5,277,062

DATED : January 11, 1994

INVENTOR(S) : Matthew E. Blauch, et al

It is certified that error appears in the above-indentified patent and that said Letters Patent is hereby corrected as shown below:

In column 4, line 56, $$MAC = \frac{\Sigma M_i (MAC)}{\Sigma M_i}$$

should read $$MAC = \frac{\Sigma M_i (MAC)_i}{\Sigma M_i}$$

Signed and Sealed this

Twenty-sixth Day of July, 1994

*Attest:*

Bruce Lehman

BRUCE LEHMAN

*Attesting Officer*

*Commissioner of Patents and Trademarks*